US007744028B2

(12) United States Patent
Zollig

(10) Patent No.: US 7,744,028 B2
(45) Date of Patent: Jun. 29, 2010

(54) STATOR FOR AN IMPACT CRUSHER

(75) Inventor: Mario Zollig, Bottighofen (CH)

(73) Assignee: swissRTec GmbH, Mammern (CH)

( * ) Notice: Subject to any disclaimer, the term of this patent is extended or adjusted under 35 U.S.C. 154(b) by 0 days.

(21) Appl. No.: 12/086,072

(22) PCT Filed: Nov. 30, 2006

(86) PCT No.: PCT/CH2006/000675

§ 371 (c)(1),
(2), (4) Date: Sep. 5, 2008

(87) PCT Pub. No.: WO2007/065283

PCT Pub. Date: Jun. 14, 2007

(65) Prior Publication Data

US 2009/0166457 A1 Jul. 2, 2009

(30) Foreign Application Priority Data

Dec. 9, 2005 (CH) ..... 1960/05

(51) Int. Cl.
*B02C 19/00* (2006.01)

(52) U.S. Cl. ..... 241/299; 241/300; 241/DIG. 30

(58) Field of Classification Search ..... 241/299, 241/300, 189.1, 89.3, 86.1, 88, 88.4, DIG. 30
See application file for complete search history.

(56) References Cited

U.S. PATENT DOCUMENTS 3,883,080 A * 5/1975 Andersson ..... 241/182
3,995,782 A * 12/1976 Shallenberger et al. .. 241/188.1
4,378,911 A * 4/1983 Adams et al. ..... 241/187
5,117,674 A 6/1992 Howard
5,639,471 A 6/1997 Chait
5,660,176 A 8/1997 Iliff
5,705,735 A 1/1998 Acorn
5,810,722 A 9/1998 Heikkila
5,860,918 A 1/1999 Schradi
5,954,640 A 9/1999 Szabo
5,989,188 A 11/1999 Birkhoelzer
6,074,345 A 6/2000 Van Oostrom
6,126,595 A 10/2000 Amano (Continued)

FOREIGN PATENT DOCUMENTS

DE 4128225 * 3/1993

(Continued)

*Primary Examiner*—Mark Rosenbaum
(74) *Attorney, Agent, or Firm*—Pauley Petersen & Erickson

(57) ABSTRACT

A reliable, inexpensive option for the plates that function as wear parts and are mounted on an inner face of a casting wall of a stator. To achieve this the plates are designed as cast parts and are fixed to the inner face of the casting wall from an exterior of the stator. The plates are fixed by fixing bolts, which are screwed into the plates through the casting wall from the exterior. The plates have transverse threaded bores that correspond to the bolts. Respective spacer rings are pushed onto the fixing bolts secured by wedge-shaped cotters in both a positive and non-positive fit, and the wedge-shaped cotter pressing on the spacer rings that lie against the outer face of the casting wall. This invention is extremely economical and improves the operational safety in comparison to known options.

13 Claims, 2 Drawing Sheets

U.S. PATENT DOCUMENTS

| | | | |
|---|---|---|---|
| 6,159,131 | A | 12/2000 | Pfeffer |
| 6,270,457 | B1 | 8/2001 | Bardy |
| 6,280,380 | B1 | 8/2001 | Bardy |
| 6,387,053 | B1 | 5/2002 | Pessenhofer |
| 6,478,736 | B1 | 11/2002 | Mault |
| 6,500,117 | B1 | 12/2002 | Hancock |
| 6,510,430 | B1 | 1/2003 | Oberwager |
| 6,547,729 | B1 | 4/2003 | Abbo |
| 6,554,776 | B1 | 4/2003 | Snow |

FOREIGN PATENT DOCUMENTS

| | | | |
|---|---|---|---|
| DE | 10047095 | * | 4/2002 |
| SU | 1082420 | * | 3/1984 |

* cited by examiner

FIG. 1
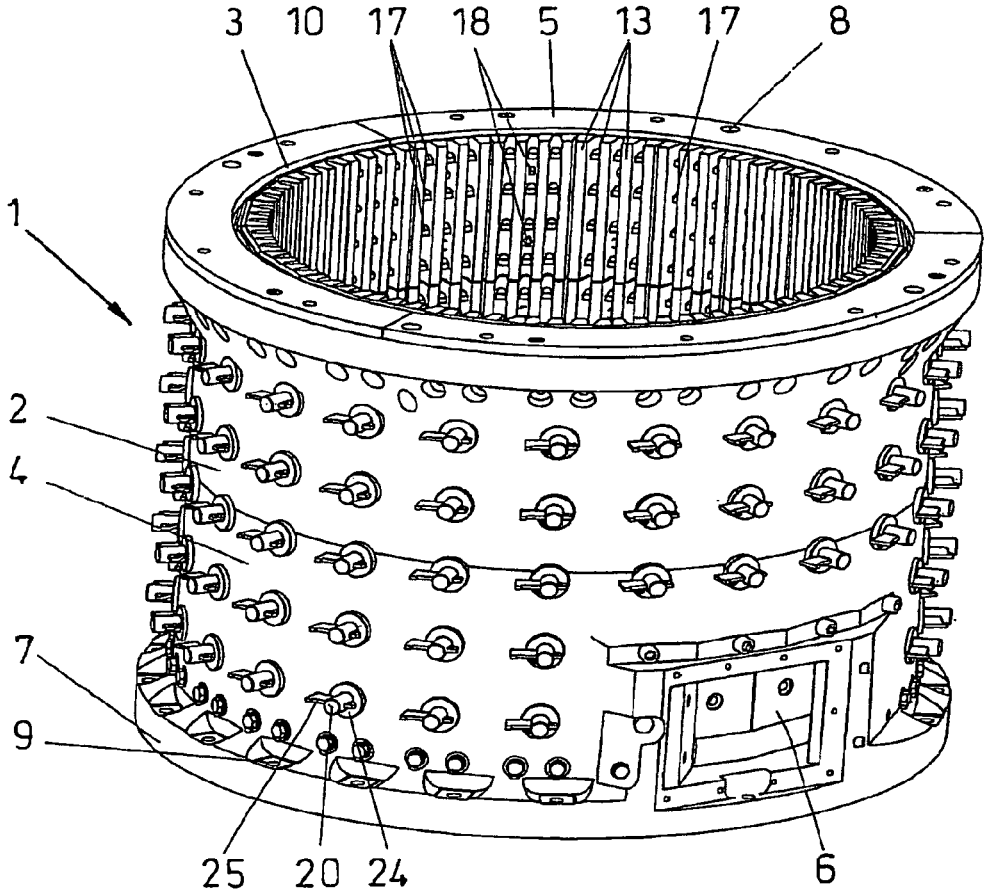
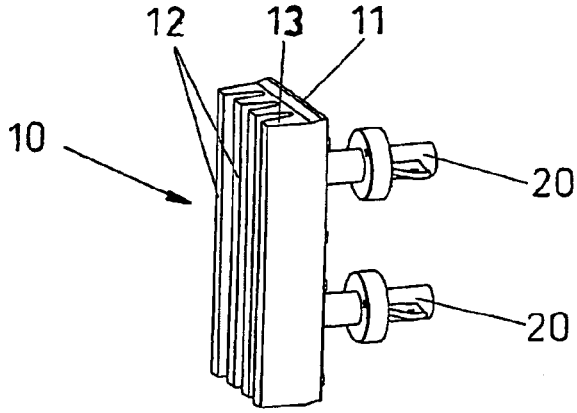
FIG. 2

STATOR FOR AN IMPACT CRUSHER

BACKGROUND OF THE INVENTION

1. Field of the Invention

This invention relates to a stator for an impact crusher for separation of compound materials, with an outer face of the casing wall and an inner face of the casing wall, which is plated with a plurality of plates with ribs, wherein the plates are designed as wear parts and are attached replaceably.

2. Discussion of Related Art

Impact crushers are used in a variety of different technical fields, but herein only the use regarding the separation of compound materials is of interest. Such compound materials can be compounds of metal/metal, plastic/plastic, metal/plastic or mineral compounds with metals and/or plastics. Because the physical properties of the individual components of the compounds are different, such compound particles are separated in impact crushers and with each impulse different materials deform unequally elastically and unequally plastically and thereby separate. Typical compound materials, which are processed by the applicant are, for example, electronic waste and shredder waste of all kind, in particular from car recycling.

The use of impact crushers in this area is associated with enormous wear of the hammer tools as well as of the crusher walls. Accordingly the crusher walls, which are the inner casing wall of respective stators of such impact crushers, are plated with replaceable plates, which comprise ribs, on which particles of the compound materials to be delaminated impinge with high energy. As soon as the ribs are reduced to a certain minimum due to respective wear, the plates have to be replaced. Typically, such plates are made from steel plates and the ribs are formed by slotting machines or by milling. The back side of such plates are fitted to the actual casing wall of the stator.

From Great Britain Patent Reference GB-A-1397674 an impact crusher is known, the stator of which comprises a carrier plate on which a plurality of rib-shaped projections are welded, between which hammer tools are rotating pivotably supported on a rotor. The respective plate is attached to hydraulic-slide elements in order to adjust the plate according to the wear. After wearout of the projections, the entire adjustable base plate has to be replaced accordingly. This requires a relatively complex disassembly.

From PCT Patent Reference WO 00/53324 (BHS Sonthofen) another impact crusher is known, which represents the closest prior art. This stator of an impact mill serves for separation of compound materials and comprises an outer face of the casing wall as well as an inner face of the casing wall, which is plated with a plurality of plates with ribs, wherein the plates are designed as wear parts and are attached replaceably. This known solution intends to simply hook-in the plates tile-like at the upper edge of the stator casing wall. Accordingly, the plates have a continuous longitudinal rib with a hook-shaped cross section extending on the upper edge portion. This longitudinal rib engages in a ring groove formed on the stator wall. Along the periphery of the stator a plurality of such plates are hooked-in. The plates, which have a relatively high weight, are kept in position solely by gravity and are positioned abutting each other relatively tight. Normally, such plates are easy to replace but the mounting of these plates carries a potentially high risk. The peripheral speed in such impact crushers can be up to several hundreds km/h, which represents a high potential energy. If bigger parts get into the impact crusher, which accordingly are hard, because the shredder could not crush them, then these parts can be wedged in between the rotor and the stator. Although the hammer tools are typically supported pivotably, instantaneous acceleration forces occur, which can result in displacing of the plates or even in unhooking. After such an event a complete revision of the impact crusher is necessary.

SUMMARY OF THE INVENTION

It is one object of this invention to provide a stator of an impact crusher for separation of compound materials with a considerably higher safety, wherein at the same time the plates, which are wear parts, can be produced inexpensively.

This object can be achieved if the plates are metal cast plates having at least one transverse threaded bore and that the outer casing wall of the stator has passages, through which the fixing bolts with threads fitting into the threaded bore of the plates can be passed through and are visible from outside of the stator.

This unique mounting method is based on the consideration that inside the impact crusher an extremely high contamination occurs and thus a principally logical and easy screwing from inside is basically not realized.

The use of plates which are designed as metal cast plates is in particular inexpensive, but the precision of the cast results in an increase of the manufacturing cost. In order to be able to work with a decreased relative accuracy it is advantageous to provide the base of the plates with supporting strips projecting slightly from the base in order to qualify the supporting accuracy.

In order to achieve the required strength also with casted plates, such plates are provided advantageously with the features described in this specification and in the claims.

Further advantageous embodiments of the subject matter of this invention are discussed in this specification and in the claims.

BRIEF DESCRIPTION OF THE DRAWINGS

The drawings show a preferred embodiment of this invention, wherein:

FIG. 1 shows a stator of an impact crusher according to this invention, in a perspective view;

FIG. 2 shows a plate for encasement of an inner face of the casing wall with respective fasteners on its own, in a perspective view;

DETAILED DESCRIPTION OF THE INVENTION

Figure 3:
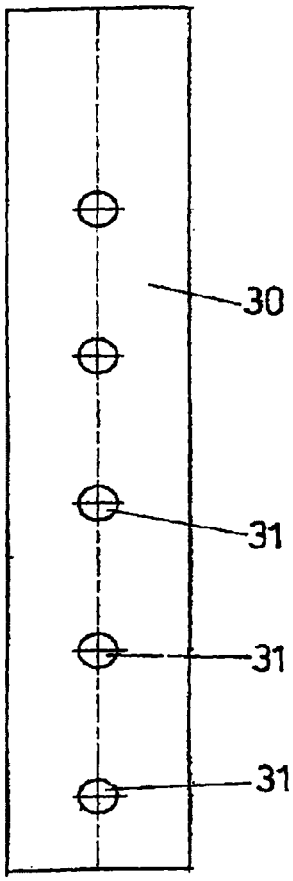
FIG. 3 shows a mat suitable for attachment between a plate and the inner wall face of the stator, in a plan view.

In FIG. 1 a general view of the inventive stator of an impact crusher is shown. The stator is denoted in general with element reference numeral 1 and has a casing wall 2, which has an inner face 3 of the casing wall 2 and an outer face 4 of the casing wall 2. The upper edge of the casing wall 2 has a circumferential collar 5 for mounting of a cover which is not shown. The lower edge of the casing wall has a mounting flange 7, with which the stator 1 can be mounted on a chassis, also not shown. The fixing bores 8 in the collar 5 serve for fixation of the mentioned cover, while the fixing bores 9 fix the casing wall 2 of the stator to the chassis. While the material to be delaminated is fed through the cover, which is not shown, into the impact crusher, the delaminated material exits through a material discharge opening 6 in the lower region of the casing wall 2. In case the impact crusher works in a reverse flow mode, an air flow is blown in through the material discharge opening 6 at the same time. The entire inner face 3 of the casing wall is plated with plates 10. This view shows that the plates 10 comprise crusher ribs 13 extending parallel to a center axis of the stator as well as reinforcement ribs 17, which are not as high as the crusher ribs 13 and which are perpendicular to the crusher ribs 13. With respect to the further design of the plates 10, reference is made to the further description of the figures.

Figure 5:
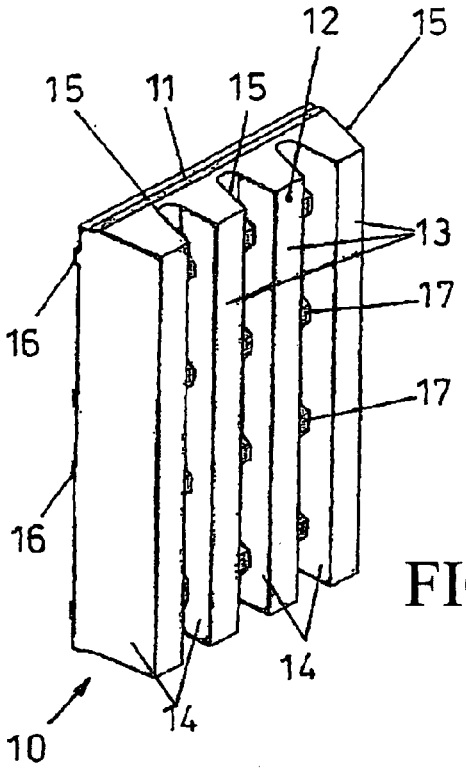
FIG. 5 shows a single plate on its own, in a perspective view.

FIG. 2 shows the plate 10 and its fasteners in the assembled condition on its own in a perspective view. The plate 10 is also shown on its own in FIG. 5. The plate 10 comprises a lower base 11, the thickness of which is relatively small with respect to the total thickness of the plate 10. The plates 10 are wear parts and accordingly it is desirable that the usage volume is relatively high in relation to the total volume. This is achieved because the crusher ribs 13 in their height form a multiple of the thickness of the lower base 11. The thickness of the base 11 need only be designed so that its strength is ensured. Also, the thickness of the base 11 is such that the fasteners are sufficiently stabilized in the plates 10. In one design, reference is made to FIG. 5.

In order to design the base 11 optimally thin, reinforcement ribs 17 are provided perpendicular to the longitudinal direction of the crusher ribs 13. The reinforcement ribs 17, however, are considerably smaller in their height than the height of the crusher ribs 13. The crusher ribs 13, the upper end faces of which define a plane, which represents the work face 12, have varying extending rib walls. Extending perpendicular to the lower base 11, first rib walls 14 are shown and on the other side second rib walls 15 extend inclined to the base 11. The first rib walls extending perpendicular to the base 11 are arranged in the mounted condition so that the particles of compound materials accelerated in the rotational direction impinge on the perpendicular faces 14. The inclined second rib walls 15 form retaining walls, so to speak, which are not directly subject to wear. The accelerated particles, which are accelerated virtually tangential by the hammer tools at the rotor, virtually impinge only at the outer end of the first rib walls 14 extending perpendicular to the base 11. Accordingly, the crusher ribs 13 are decreasing in their height due to the abrasion and it is not the crusher ribs 13 that become thinner and thinner, as could be expected. So that the working gap between the hammer tools at the rotor and the crusher ribs 13 at the stator stays within a small tolerance range, the efficiency of the impact crusher is maintained, and the hammer tools at the rotor are attached radially movable outwards.

The mounting of the plates 10 is achieved with the fixing bolts 20. Normally, each plate 10 is attached with two fixing bolts. The fixing bolt is in principle cylindrical and only the end has an outside thread tapered in the region of the thread 21, so that at the transition between the cylindrical portion of the fixing bolt 20 and the threaded portion 21 a shoulder 22 is formed. In the screwed-in condition, the shoulder 22 rests on the lower surface of base 11. The fixing bolts 20 are inserted through the casing wall 2 of the stator 1. Accordingly, along the entire periphery of the casing wall 2 respective bores are provided regularly. The fixing bolts 20 have a slotted hole 23 penetrating the bolt diametrically. This slotted hole 23 extending in the longitudinal axis of the fixing bolt 20 is dimensioned so that a respective wedge-shaped cotter 25 is insertable therethrough in a positive and non-positive fit. For each fixing bolt 20 there is an associated spacer ring 24. The thickness of the spacer rings is selected in a manner that in a correctly mounted condition the wedge-shaped cotter 25 pushed through the slotted hole 23 is pressing on the spacer ring 24. The obtained contact pressure prevents loosening of the fixing bolts 20. So that the wedge-shaped cotter 25 cannot fall out of the slotted hole 23, the wedge-shaped cotter 25 can be secured by a locking pin 29. The locking pin 29 is pushed through a transverse hole 27 in the cotter. The locking pin 29 itself can, for example, be connected with the spacer ring 24, which also has a transverse bore 26, through a connection element 28. Thus, the locking pin cannot get lost. The connection element 28 can be, for example, a wire or metal wire rope.

Figure 6:
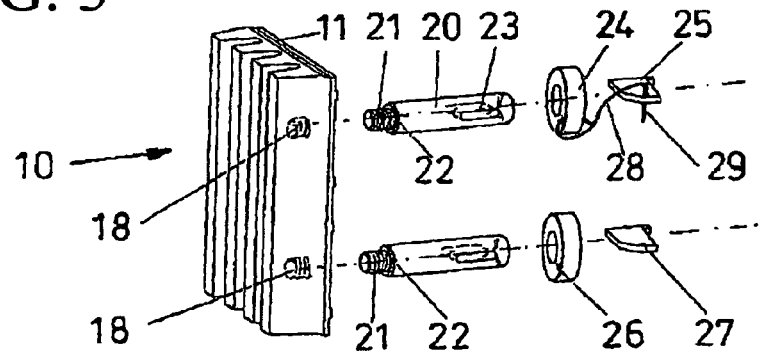
FIG. 6 shows the same plate together with the fasteners, in a perspective exploded view.

The transverse threaded bore 18 can virtually be seen only in the view according to FIG. 1. In FIG. 6, the two bores are only schematically drawn in a dashed line to indicate, where these transverse threaded bores 18 are located.

Figure 4:
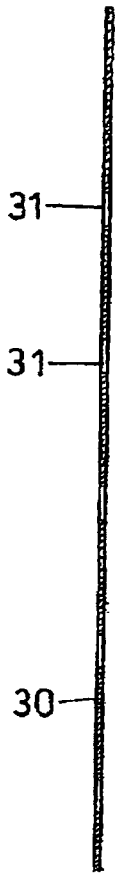
FIG. 4 shows the same mat but in a side view.

Between the base 11 of the plates 10 and the inner face 3 of the casing wall, mats 30 are placed. The mats 30 can, for example, be made of a vulcanized rubber. The mats 30 comprise on a central longitudinal axis as many holes 31 as fixing bolts 20 are penetrating the same. The size of the mats 30 can be equal to the length and width of the base 11 of a plate or to an integer multiple of the edge lengths of the plates 10. In the illustrated example, the mat 30 in the FIGS. 3 and 4 is designed corresponding to the width of a plate, and its length corresponds to the height of the casing wall 2 of the stator. Also within a stator, plates with different sizes can be used. However, the width of all plates is preferably designed identical, while their length is, for example, designed differently, so that as illustrated here, two or three rows on top of each other are sufficient. While plates with a large length are mounted with two fixing bolts 20, plates with the half of the length are mounted to the casing wall 2 only with one single fixing bolt. The different plate lengths are required in order to obtain the necessary recess for the material discharge opening 6 without the need for special plates.

Preferably, the stator has an inner surface with a quadrangle cross section. This allows an at least approximately planar support of the plates 10. The plates 10 made of steel cast have a planar base 11. In addition, the plates 10 comprise supporting strips with a relatively small height at the base 11. The formed supporting strips 16 may not be obligatory but they improve the support on the inner face 3 of the wall casing of the stator 1 because the same can exhibit casting unevenness. The linear support can be realized much simpler than a support with full contact. At the same time, in a preferred embodiment according to this invention, a mat 30, as mentioned earlier, is placed between the inner face 3 of the casing wall and the base 11 of the plates. The mat not only serves as a compensation to obtain a fairly planar support but also effects at the same time a certain vibration dampening and thereby results in a reduction of sound emission. With the measures the vibrations are also reduced to the point that no loosening of the fixing bolts 20 takes place.

With the fixing bolts easily accessible from the exterior and their easy locking, the replacement of the plates on the inner face of the casing wall is possible with a considerably shorter downtime of the operation compared to options which provide a different mounting, while at the same time however the safety is very high. For replacement of the plates the cover, not shown here, is removed and thereafter the complete rotor is pulled out so that the plates are freely accessible.

The use of casted plates, which in principle are wear parts, is considerably less expensive than the previously used options, which are realized on machining centers in conventional mechanical engineering.

The invention claimed is:

1. A stator (1) of an impact crusher for separation of compound materials with an outer face (4) of the casing wall and an inner face (3) of the casing wall, which is plated with a plurality of plates (10) with ribs (13, 17), wherein the plates are designed as wear parts and are attached replaceably, the stator comprising: the plates being metal cast plates having at least one transverse threaded bore (18) casted within the metal cast plates, and the outer casing wall (4) of the stator having passages through which fixing bolts (20) with threads fitting into the threaded bore of the plates can be passed through and are visible from an outside of the stator, wherein the fixing bolts (20) comprise a slotted hole (23) disposed on the outside of the stator and through which a wedge-shaped cotter (25) is insertable.

2. The stator according to claim 1, wherein the plates (10) comprise a substantially planar lower base (11) and an upper work face (12), the work face is formed by parallel ribs, the first rib walls (14) of which are each extending perpendicular to the base (11) and axially parallel inwards to a stator center axis in a mounted condition, while the second rib walls (15) extend inclined with respect to the base.

3. The stator according to claim 2, wherein the bases (11) of the plates (10) comprise supporting strips (16) which project slightly from the base.

4. The stator according to claim 2, wherein perpendicular to a longitudinal direction of the crusher ribs (13) reinforcement ribs (17) are extending between the crusher ribs.

5. The stator according to claim 1, wherein the plates are attached on the inner face (3) of the casing wall with at least an intermediate rubber mat (30) therebetween.

6. The stator according to claim 1, wherein over the fixing bolt (20) a spacer ring (24) is pushed which rests on the outer face (4) of the casing wall and the wedge-shaped cotter (25) is pressing on the spacer ring (24).

7. The stator according to claim 6, wherein both the spacer ring (24) and the wedge-shaped cotter (25) each have a transverse bore (26, 27) through which a connection element (28) is inserted.

8. The stator according to claim 1, wherein between the plates (10) and the inner face (3) of the casing wall of the stator a rubber-elastic mat (30) is placed.

9. The stator according to claim 8, wherein the mat (30) corresponds to a width and a height of a plate (10) or to integer multiples of the width and the height.

10. The stator according to claim 8, wherein the mat (30) corresponds to the width of the plate and the height of the inner face (3) of the casing wall.

11. The stator according to claim 1, wherein the stator comprises a polygonal inner cross section, a width of an edge of the polygon is fitted to a width of the plate, and the plate (10) can rest planar, indirectly or directly, on the inner face of the stator.

12. The stator according to claim 1, wherein a plate (10) for encasement of the stator (1) of the impact crusher is for separation of compound materials, with the outer face (4) of the casing wall and the inner face (3) of the casing wall, which is plated with a plurality of plates (10) with ribs (13, 17), wherein the plates designed as wear parts are attached replaceable, and the plates are metal cast plates having at least one transverse threaded bore (18).

13. A stator of an impact crusher for separation of compound materials, comprising:

a casing wall having an outer face and an inner face, a plurality of metal cast plates designed as wear parts and replaceably attached on the inner face, each of the plurality of plates including crusher ribs extending in a longitudinal direction and reinforcement ribs extending between the crusher rib and perpendicular to the longitudinal direction;

threaded bores cast within each of the metal cast plates on a side facing the inner face;

passages extending through the casing wall of the stator and each aligned with one of the threaded bores;

fixing bolts including threads fitting into the threaded bores of the plates, the fixing bolts each having a portion that extends through one of the passages, is visible from an outside of the stator, and includes a slotted hole disposed on the outside of the stator;

a plurality of wedge-shaped cotters each insertable within the slotted hole of one of the fixing bolts.

* * * * *